US008905567B2

(12) United States Patent
Ho

(10) Patent No.: US 8,905,567 B2
(45) **Date of Patent: *Dec. 9, 2014**

(54) DISPLAY DEVICE FOR LIGHTING OBJECTS

(71) Applicant: Su-Fang Ho, New Taipei (TW)

(72) Inventor: Su-Fang Ho, New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/925,979

(22) Filed: Jun. 25, 2013

(65) Prior Publication Data

US 2014/0003036 A1 Jan. 2, 2014

(30) Foreign Application Priority Data

Jun. 27, 2012 (TW) ..... 101212402 A

(51) Int. Cl.

| | |
|---|---|
| ***F21V 33/00*** | (2006.01) |
| ***F21V 7/00*** | (2006.01) |
| ***F21V 7/07*** | (2006.01) |
| ***G09F 19/00*** | (2006.01) |
| ***F21S 6/00*** | (2006.01) |
| ***F21S 10/00*** | (2006.01) |

(52) U.S. Cl.

CPC ..... *F21V 33/00* (2013.01); *F21S 6/002* (2013.01); *F21V 7/00* (2013.01); *F21S 10/002* (2013.01); *Y10S 362/806* (2013.01); *Y10S 362/811* (2013.01)

USPC ..... 362/101; 362/318; 362/806; 362/811; 362/297; 362/296.09; 40/406; 40/407

(58) Field of Classification Search

CPC ..... F21S 10/00; F21S 10/002; F21S 13/12; F21S 6/002; G09F 13/24; G09F 19/02; G09F 13/12; F21W 2121/00; F21V 7/00; G02F 1/133605; Y10S 362/806

USPC ..... 362/96, 101, 318, 806, 811, 297, 362/296.09, 311.11; 40/406–408

See application file for complete search history.

(56) References Cited

U.S. PATENT DOCUMENTS

| | | | | | |
|---|---|---|---|---|---|
| 2,731,747 | A | * | 1/1956 | Hazelroth et al. | 40/406 |
| 3,501,227 | A | * | 3/1970 | Landen | 359/866 |
| 3,531,635 | A | * | 9/1970 | Hancock | 362/101 |
| 4,121,279 | A | * | 10/1978 | Whitesel | 362/297 |
| 4,139,955 | A | * | 2/1979 | Reiback | 40/427 |
| 4,462,789 | A | * | 7/1984 | Nakamura | 431/126 |
| 4,714,984 | A | * | 12/1987 | Spector | 362/101 |
| 5,180,222 | A | * | 1/1993 | Robinson | 362/125 |
| 5,262,929 | A | * | 11/1993 | Lenhart | 362/161 |
| D472,009 | S | * | 3/2003 | Eisenberg | D26/96 |
| 7,163,315 | B2 | * | 1/2007 | Chang et al. | 362/245 |
| 2004/0075996 | A1 | * | 4/2004 | Lee | 362/101 |
| 2014/0003035 | A1 | * | 1/2014 | Tsai | 362/101 |

* cited by examiner

*Primary Examiner* — Robert May
*Assistant Examiner* — Alexander Garlen
(74) *Attorney, Agent, or Firm* — Rosenberg, Klein & Lee

(57) ABSTRACT

A display device for lighting objects comprising: a frame having a vision window at a front side thereof, a film-coated glass mounted on the vision window, a support bracket arranged in the frame and having at least one positioning hole thereon, a lighting object having at least a part thereof arranged in the positioning hole and two pieces of refection mirrors having a center serving as a reference to define the first and second symmetrical reflection mirrors and both sides thereof inclined forward to form an angle between 145° and 175°. After a lighting object is reflected repeatedly by the two or more than two reflection mirrors, the vision window shows shapes in an inward serial arrangement from the middle to unlimited extension at both sides, providing effects of an illumination lamp device, an art decoration, and special visions in one unit.

9 Claims, 9 Drawing Sheets

DISPLAY DEVICE FOR LIGHTING OBJECTS

BACKGROUND OF THE INVENTION

1. Field of the Invention

The invention relates to a display device for lighting objects, and more particularly to a lighting object forms shapes being in an inward serial arrangement in the middle and unlimited extension and diffusion on both sides when the non-parallel reflection surfaces are reflected repeatedly.

2. Description of the Related Art

With reference to FIG. 1A, U.S. Pat. No. 3,570,156 discloses a lava lamp display device 80 comprising: a glass vessel 81 having a bottom 82 arranged in a hollow conical metallic seating 83 and located on an electric light bulb 84. Moreover, the glass vessel 81 has two immiscible components such as liquid 85 and a paraffin 86 which has a higher density than the liquid 85 at room temperature and a lower density than the liquid 85 after heating. After the electric light bulb 84 is turned on, the paraffin 86 in the bottom 82 of the glass vessel 81 is heated and flows in the liquid 85. At the same time, the electric light bulb 84 projects the light in the glass vessel 81, forming a lighting effect and becoming decorations at home and office.

The lava lamp display device 80 has lighting effect only in a single glass vessel 81. As a decoration, it seems monotonous and lack of visual effects. Therefore, there is room for improvement.

With reference to FIG. 1B, a conventional water dancing speaker 90 disclosed a base 91 with a speaker 93 thereon, a transparent bottle 92 being able to emit lights, a power cord 96, an audio cable 95 and a plurality of projection holes. When the music is on, the projection holes sprays water and emits light with the strength of music beats. It is the prior art and thus will not be described in details here.

Both the water dancing speaker 90 as well as the lava lamp display device 80 is a decoration with lighting and water-flow changes inside the single transparent bottle only and therefore it seems monotonous and lack of visual effects. Therefore, there is also room for improvement.

SUMMARY OF THE INVENTION

It is a primary object of the present invention to provide a display device for lighting objects, which provides a lighting object in a frame with a vision window to form shapes being in an inward serial arrangement in the middle and unlimited extension and diffusion on both sides when a transparent bottle of the lighting object is reflected repeatedly by the non-parallel reflection surfaces for having effects of an illumination lamp device, an art decoration, and special visions in one unit.

In order to achieve the above object, the invention includes: a frame having an opening at a back side thereof and a permeable vision window at a middle of a front side thereof; a support bracket arranged in the frame and having at least one positioning hole thereon; a lighting object having at least a part thereof arranged in the positioning hole, a base and a transparent bottle being able to emit light effect and correspondingly arranged at a height of the vision window; a film-coated glass mounted on the vision window and having a front side with light transmittancy facing toward an external part of the vision window and a reverse side with reflectivity; a first reflection mirror and a second refection mirror fixed on the support bracket, located at a rear side of the transparent bottle and having reflection surfaces facing forward, and a center thereof serving as a reference to define the first and second symmetrical reflection mirrors and both sides of the first and second reflection mirrors inclined forward to form an angle being not parallel with the film-coated glass with 180° angle but between 145° and 175°; after contents of the transparent bottle are reflected repeatedly and cumulatively by the first and second reflection mirrors the vision window shows shapes in an inward serial arrangement from the middle to the unlimited extension and diffusion at both sides thereof; and a cover plate arranged at the back opening of the frame.

Base on the features disclosed, the support bracket includes two standing plates, an upper transom plate and a lower transom plate arranged between the two standing plates; the positioning hole is arranged at a middle of the lower transom plate for arranging the part of the lighting object.

Further, the upper transom plate and the lower transom plate of the support bracket have rear sides corresponding to the angle of the first and second reflection mirrors defines two symmetrical inclined faces to form a predetermined slope for fitting with the angle of the first and second reflection mirrors.

The upper transom plate further includes a horizontal third reflection mirror at a bottom surface thereof is located at a top front side of the first and second reflection mirrors. The two standing plates include an inserted groove at corresponding inner sides thereof for the horizontal third reflection mirror to be inserted and fixed therein.

Moreover, the two standing plates of the support bracket further includes a symmetrical fourth and fifth reflection mirrors retracted from front to back to form an inclined angle in front of the both sides of the first and second reflection mirrors.

The frame further includes a seat arranged at a bottom surface thereof, and an illuminating light source and a lamp shade arranged at a top surface thereof. The seat includes a power supply therein to supply power for the lighting object and the illuminating light source.

DETAILED DESCRIPTION OF THE PREFERRED EMBODIMENT

Figure 1A:
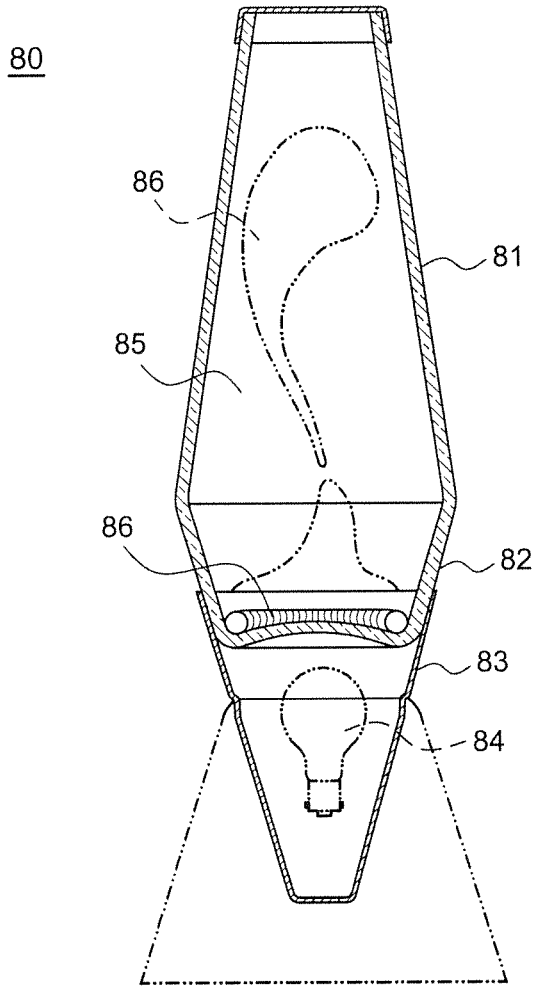
FIG.1A PRIOR ART
FIG. 1A is a sectional view of a conventional display device according to U.S. Pat. No. 3,570,156.
Figure 1B:
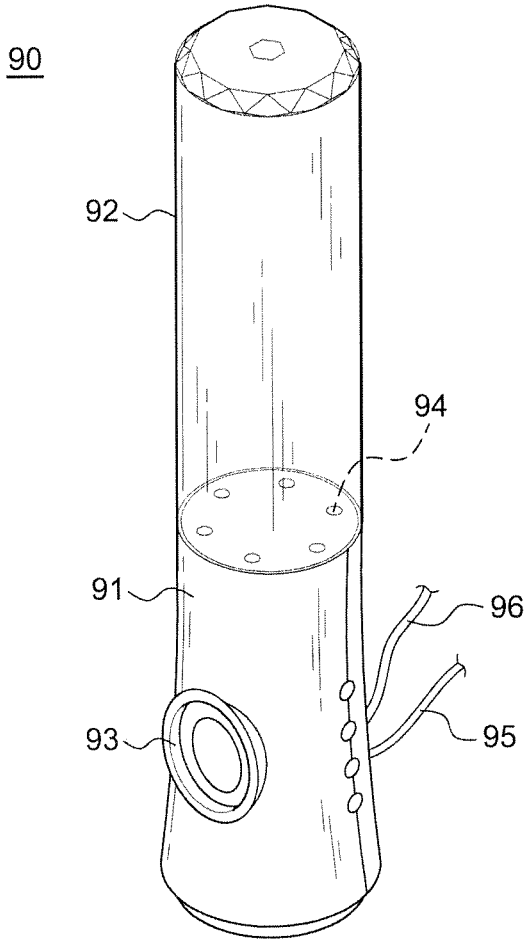
FIG.1B PRIOR ART
FIG. 1B is an appearance view of a conventional water dancing speaker.

Referring to FIGS. 2 through 7, the preferred embodiment of a display device for lighting objects in accordance with the present invention comprises: a frame 10, a film-coated glass 20, a support bracket 30, a lighting object 40, a first and second reflection mirrors 50A, 50B and a cover plate 60.

The frame 10 includes an opening at a back side thereof and a permeable vision window 11 at a middle of a front side thereof. In this embodiment, the frame 10 has a seat 14 at a bottom surface thereof. The seat 14 has a containing room 141 therein for accommodating a power supply 16 such as a transformer and a bottom plate 17 arranged at a bottom thereof for closing the containing room 141, and a through hole 13 is arranged between the bottom surface of the frame 10 and the containing room 141. Further, the frame 10 has a plurality of ventilation holes 12 at the front side thereof to a bottom of the vision window 11 and the power supply 16 has an external power cord 161 and a power supply wire 162.

Figure 8:
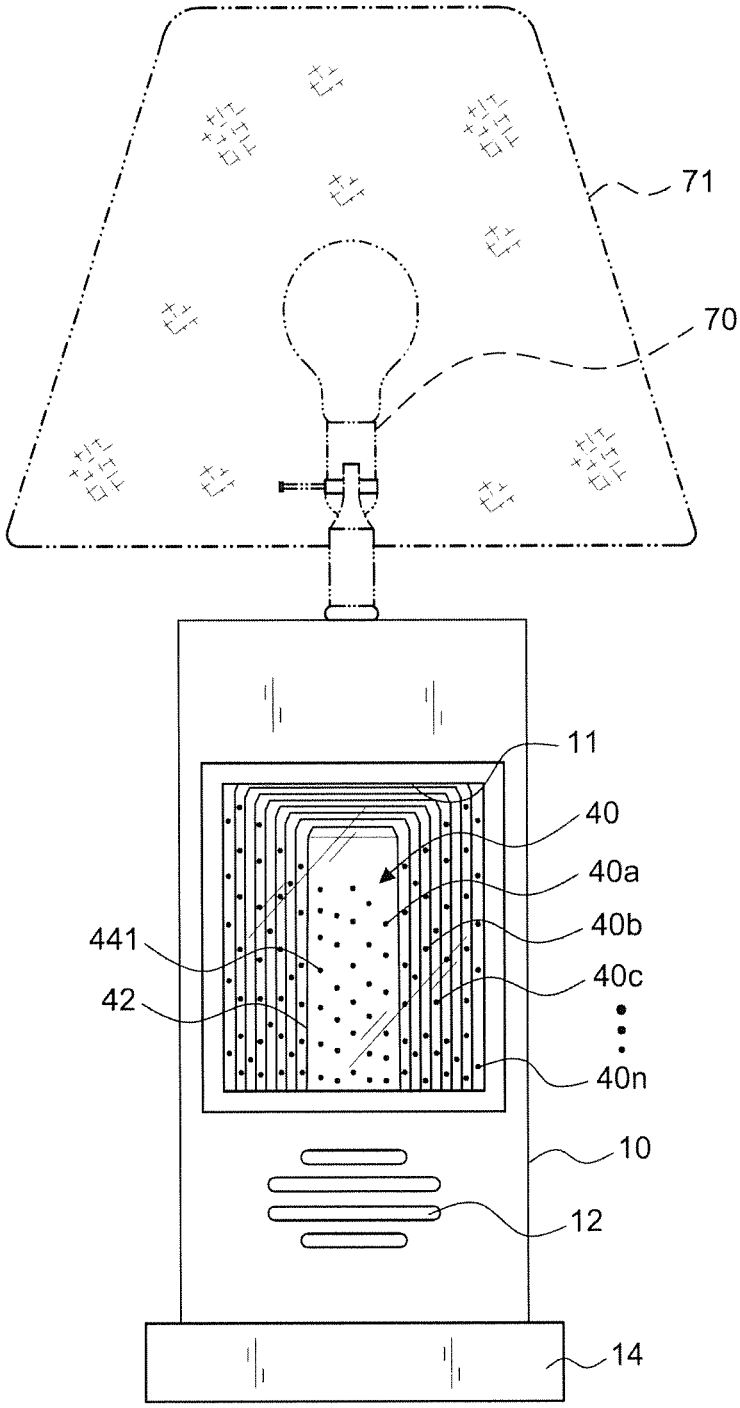
FIG. 8 is an application example view of the present invention.

With the reference to FIG. 8, the frame 10 may have an illuminating light source 70 and a lamp shade 71 arranged at a top surface thereof; such that, the present invention may be an illumination lamp. The power supply 16 supplies power for the lighting object 40 in the frame 10 and the illuminating light source 70.

The film-coated glass 20 is mounted on the vision window 11 and includes a front side with light transmittancy and a reverse side with reflectivity, which are physical characteristics of the film-coated glass 20 and thus will not be described in details here. In this embodiment, the front side of film-coated glass 20 faces toward an external part of the vision window 11.

The support bracket 30 is arranged in the frame 10 and has at least one positioning hole 33 thereon. With the reference to FIG. 2, the support bracket 30 includes two standing plates 31, an upper transom plate 32A and a lower transom plate 32B arranged between the two standing plates 31; the positioning hole 33 is arranged at a middle of the lower transom plate 32B for arranging a part of the lighting object 40. The support bracket 30 may be an independent body separated from the frame 10 or may be fixed with the frame 10.

The lighting object 40 includes a base 41 with a speaker 43 thereon, a transparent bottle 42 being able to emit light effect and a plurality of projection holes 44 with light-emitting and water-spraying functions. Further, a power cord 45 is provided for connecting to the power supply power 16 and an audio cable 46 is provided for connecting to an external music; so that the projection holes 44 sprays water and emits light 441 with the strength of music beats when the music is on. Certainly, the lighting object 40 may be a lava lamp as shown in FIG. 1A, having a transparent bottle being able to emit light effect and therefore is also applicable to the display device in accordance with the present invention; however, the water dancing speaker, lava lamp and other lighting objects are prior arts and thus the principles and functions thereof will not be described in details here.

In this embodiment, the lighting object 40 is upward penetrated from the containing room 141 of the seat 14 through the through hole 13 of the frame 10 for the transparent bottle 42 of the lighting object 40 correspondingly to be set at a height of the vision window 11 and for the part of the lighting object 40 to be fixed in the positioning hole 33 and then a pad 15 is positioned on the through hole 13 by a screw 151 to prevent the lighting object 40 from loosening. However, the positioning method of the lighting object is not a limitation.

The first and second reflection mirrors 50A, 50B fixed on the support bracket 30 are located at a rear side of the transparent bottle 42, and have back surfaces coating with a light-reflecting coating 51, reflection surfaces 52 facing forward and a center serving as a reference to define the two pieces of symmetrical reflection mirrors 50A, 50B, and both sides of the two pieces of symmetrical reflection mirrors 50A, 50B are inclined forward to form an angle θ being not parallel with the film-coated glass 20 with 180° angle but between 160° and 175° angles. After the content object in the transparent bottle 40 between the film-coated glass 20 and the first and second reflection mirrors 50A, 50B is repeatedly and cumulatively reflected by the first and second reflection mirrors 50A, 50B, the vision window 11 shows shapes in an inward serial arrangement from the middle infinitely extended and diffused to the both sides. Moreover, a cover plate 60 is arranged at the back opening of the frame 10.

Figure 2:
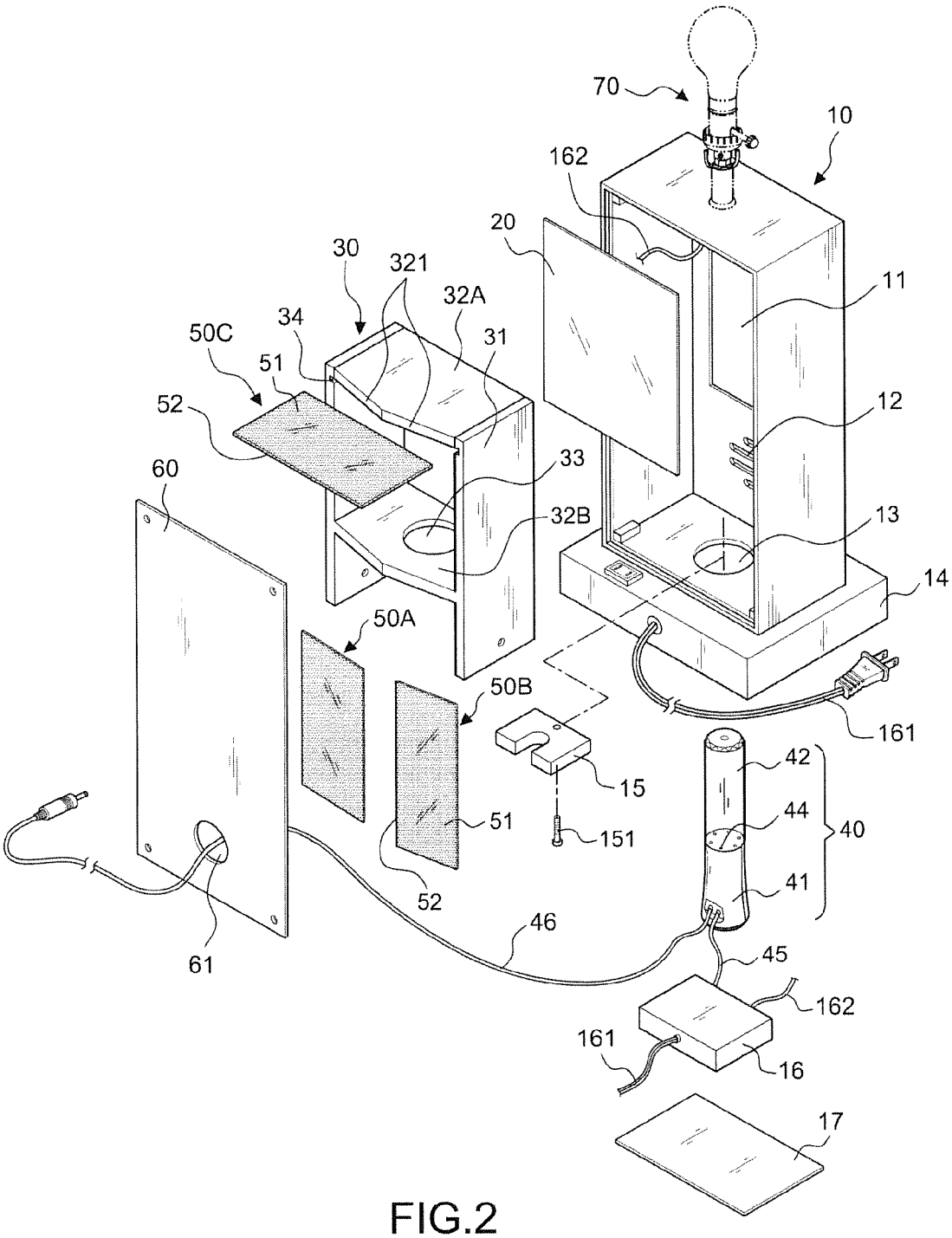
FIG. 2 is an exploded perspective view of the present invention, showing from a back of the present invention.
Figure 3:
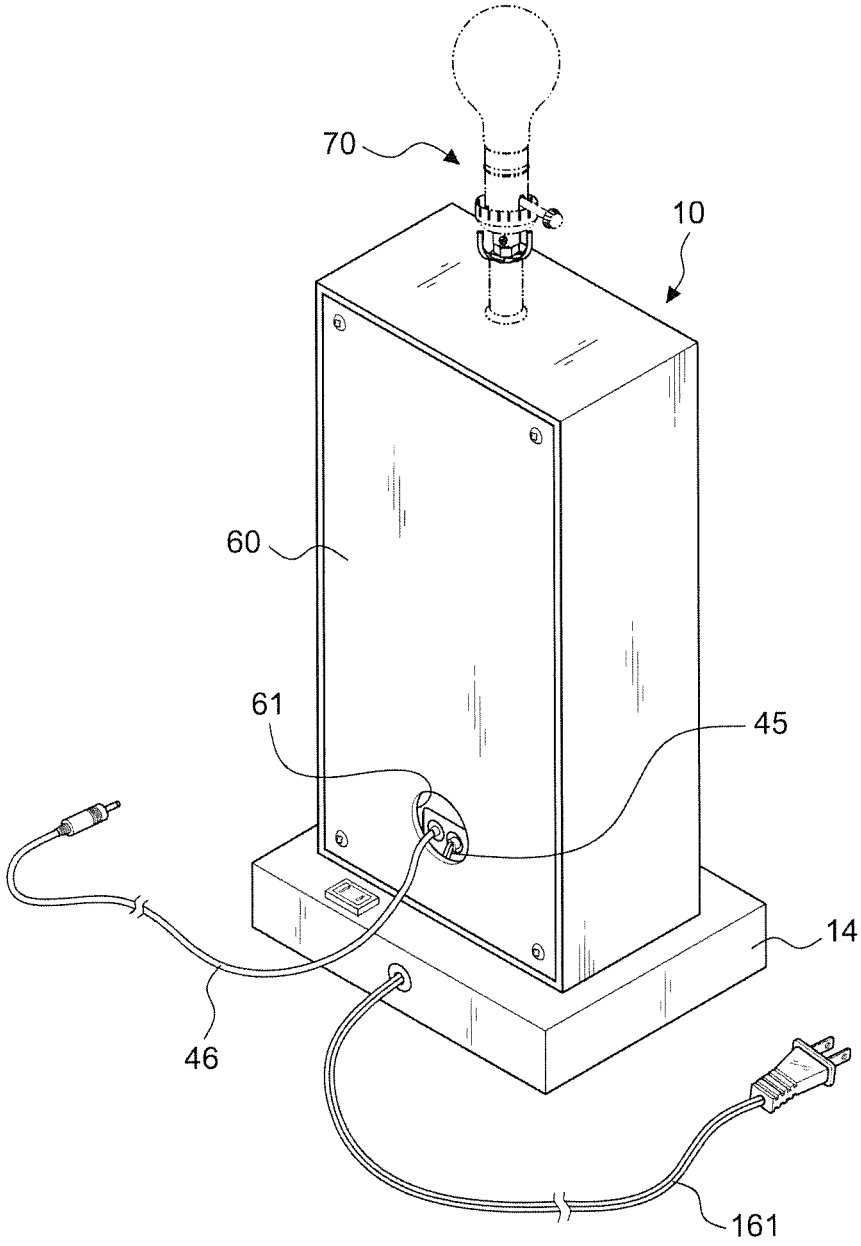
FIG. 3 is a perspective view of the present invention in a fully assembled state, showing from a right side of a back of the present invention.
Figure 4:
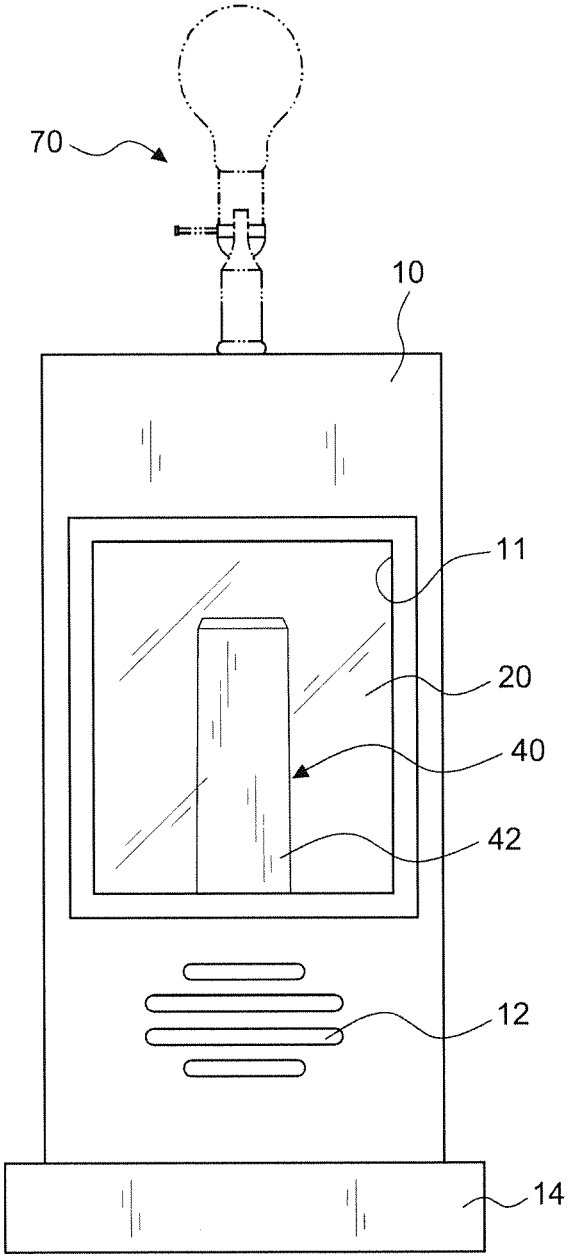
FIG. 4 is a front side schematic view of the present invention.
Figure 5:
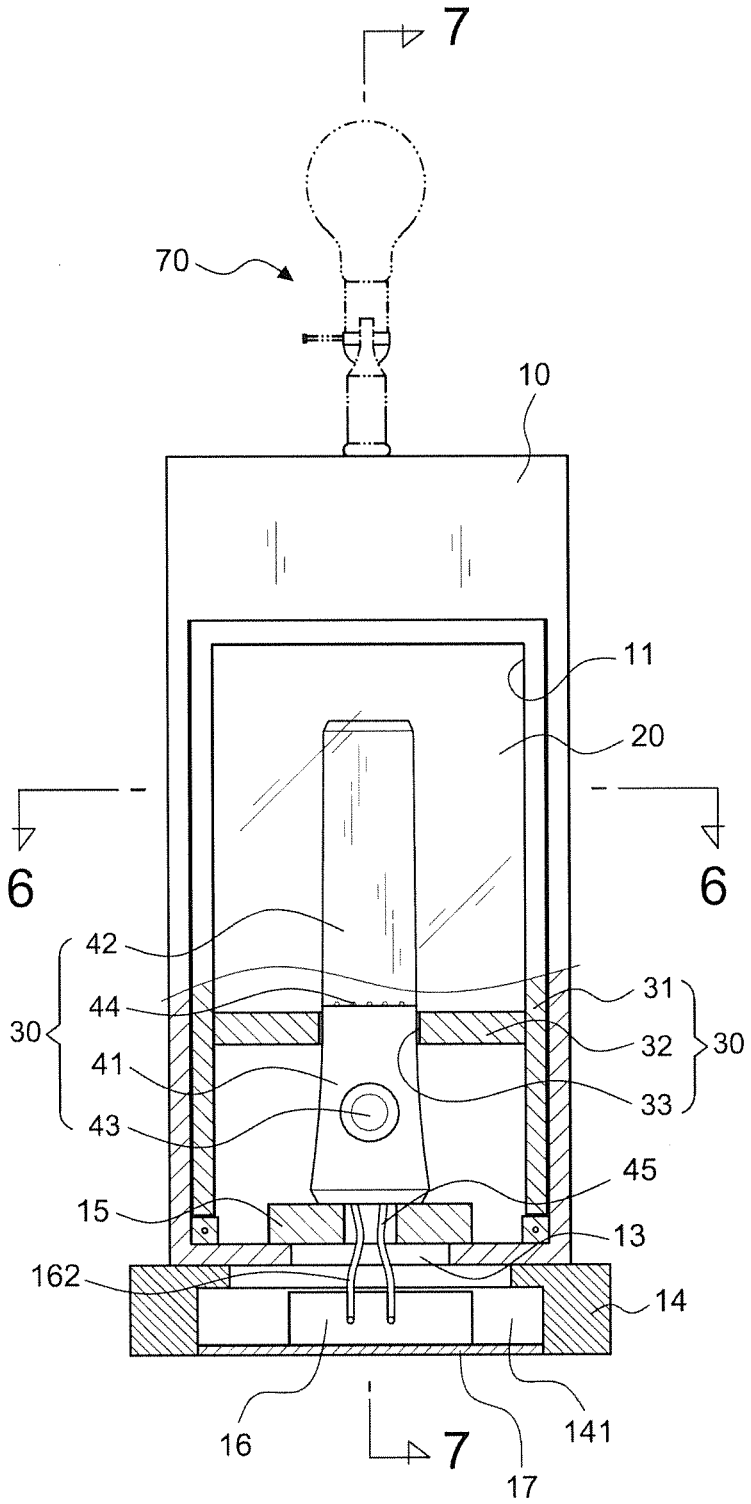
FIG. 5 is semi-sectional view of a front side of the present invention.
Figure 7:
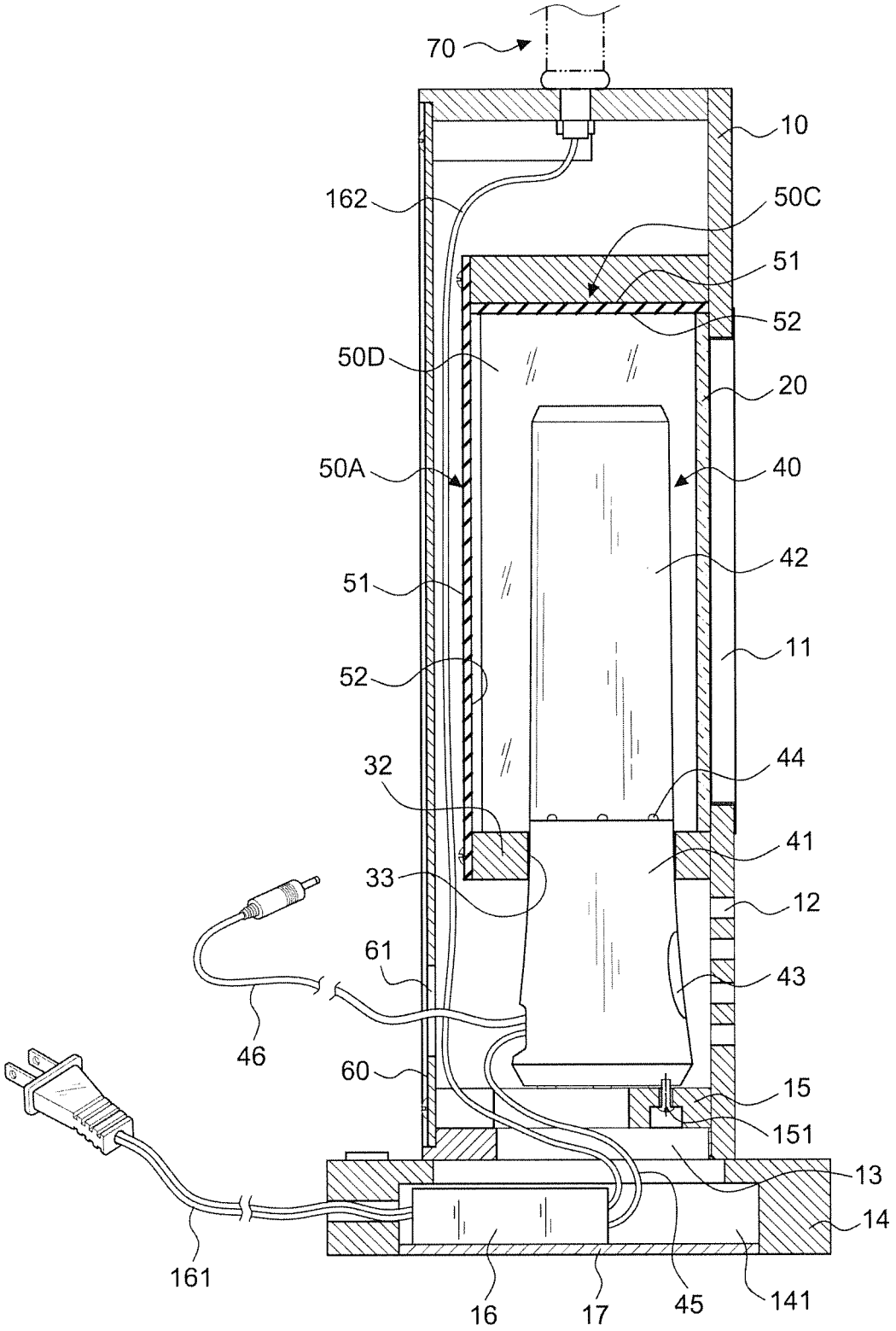
FIG. 7 is a cross-sectional view taken along the line 7-7 in FIG. 5.

Further, the upper transom plate and lower transom plate 32A, 32B of the support bracket 30 have rear sides corresponding to the angle θ of the first and second reflection mirrors 50A, 50B define symmetrical inclined faces 321 to form a predetermined slope for fitting with the angle θ of the first and second reflection mirrors 50A, 50B. In an applicable embodiment, the first and second reflection mirrors 50A, 50B form the angle θ between 160° and 175° for a single transparent bottle 42 to be accumulated more than six reflection bottles, having an excellent extended stereoscopic sense In another applicable embodiment as shown in FIGS. 2 and 7, the upper transom plate 32A may further include a horizontal third reflection mirror 50C at a bottom surface thereof is located at a top front side of the first and second reflection mirrors 50A, 50B. The third reflection mirror 50C also has back surface coating with the light-reflecting coating 51 and the reflection surface 52 facing downward. In the embodiment, the two standing plates 31 include an inserted groove 34 at corresponding inner sides thereof for the horizontal third reflection mirror 50C to be inserted and fixed therein. Accordingly, the present invention provides horizontal reflection mirror and vertical reflection mirrors for the single transparent bottle 42 having richer stereoscopic sense through repeated and accumulated reflection as well as extended diffusion.

Figure 6:
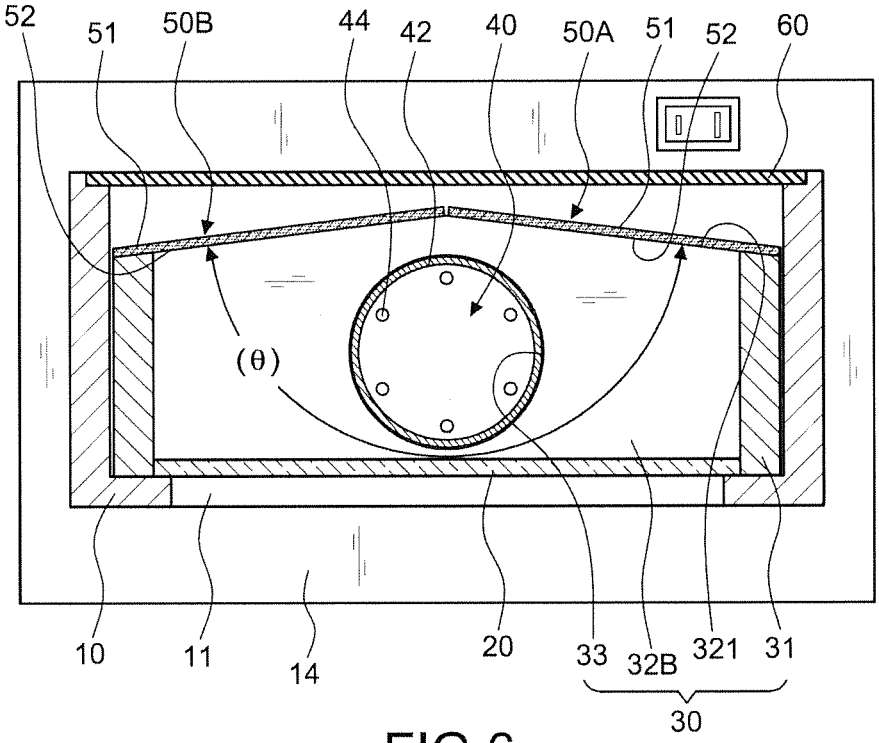
FIG. 6 is a cross-sectional view taken along the line 6-6 in FIG. 5.
Figure 6A:
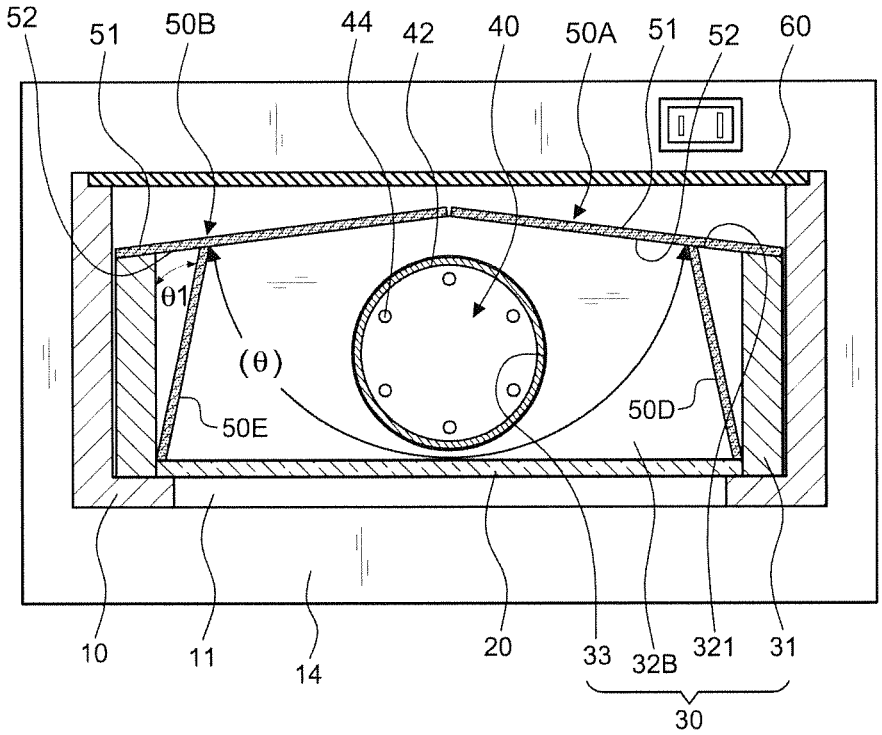
FIG. 6A is a sectional view of another applicable embodiment in accordance with the present invention.

Moreover, the two standing plates 31 of the support bracket 30 as shown in FIG. 6 further includes a symmetrical fourth and fifth reflection mirrors 50D, 50E retracted from front to back to form an inclined angle θ1. In the embodiment, the symmetrical fourth and fifth reflection mirrors 50D, 50E form the inclined angle θ1 between 10° and 20° in front of the both sides of the first and second reflection mirrors 50A, 50B. In the applicable embodiment, the fourth and fifth reflection mirrors 50D, 50E are provided for the angle θ of the first and second reflection mirrors 50A, 50B being between 145° and 160° which has an excellent reflection and extended diffusion effect.

FIG. 8 is a practical application view of the present invention, illustrating the projection holes 44 spraying water and emitting light 441 when the lighting object 40 is turned on. The lighting object 40 as shown in FIG. 6 is arranged between the film-coated glass 20 and the first and second reflection mirrors 50A, 50B for the projection holes 44 spraying water and emitting light 441 and then the vision window 11 as shown in FIG. 8 shows the lighting object 40 in an inward serial arrangement from the middle infinitely extended and diffused to the both sides, such as 40*a*, 40*b*, 40*c* . . . 40*n*; thus, the present invention has 3D visual perception, rather than the conventional lava lamp with signal vision or the conventional water dancing speaker without visions. Therefore, the present invention has effects of an illumination lamp device, an art decoration, and special visions in one unit.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A display device for lighting objects, comprising:

a frame having an opening at a back side thereof and a permeable vision window at a middle of a front side thereof;

a film-coated glass mounted on the vision window and having a front side with light transmittancy facing toward an external part of the vision window and a reverse side with reflectivity;

a support bracket arranged in the frame and having at least one positioning hole thereon;

a lighting object having at least a part thereof arranged in the positioning hole, a base and a transparent bottle being able to emit light effect and correspondingly arranged at a height of the vision window;

a first reflection mirror and a second refection mirror fixed on the support bracket, located at a rear side of the transparent bottle and having reflection surfaces facing forward, and a center thereof serving as a reference to define the first and second symmetrical reflection mirrors and both sides of the first and second reflection mirrors inclined forward to form an angle being not parallel with the film-coated glass with 180° angle but between 145° and 175°; after contents of the transparent bottle are reflected repeatedly and cumulatively by the first and second reflection mirrors, the vision window shows shapes in an inward serial arrangement from the middle to the unlimited extension and diffusion at both sides thereof; and a cover plate arranged at the back opening of the frame.

2. The display device for lighting objects as claimed in claim 1, wherein the support bracket includes two standing plates, an upper transom plate and a lower transom plate arranged between the two standing plates; the positioning hole is arranged at a middle of the lower transom plate for arranging the part of the lighting object.

3. The display device for lighting objects as claimed in claim 2, wherein the upper transom plate and the lower transom plate of the support bracket have rear sides corresponding to the angle of the first and second reflection mirrors defines two symmetrical inclined faces to form a predetermined slope for fitting with the angle of the first and second reflection mirrors.

4. The display device for lighting objects as claimed in claim 3, wherein the upper transom plate further includes a horizontal third reflection mirror at a bottom surface thereof is located at a top front side of the first and second reflection mirrors.

5. The display device for lighting objects as claimed in claim 4, wherein the two standing plates include an inserted groove at corresponding inner sides thereof for the horizontal third reflection mirror to be inserted and fixed therein.

6. The display device for lighting objects as claimed in claim 2, wherein the two standing plates of the support bracket further includes a symmetrical fourth and fifth reflection mirrors retracted from front to back to form an inclined angle in front of the both sides of the first and second reflection mirrors.

7. The display device for lighting objects as claimed in claim 1, wherein the frame further includes a seat arranged at a bottom surface thereof, and an illuminating light source and a lamp shade arranged at a top surface thereof.

8. The display device for lighting objects as claimed in claim 7 wherein the seat includes a power supply therein to supply power for the lighting object and the illuminating light source.

9. The display device for lighting objects as claimed in claim 1, wherein the frame has a plurality of ventilation holes at the front side thereof to a bottom of the vision window.

* * * * *